United States Patent [19]

Glang

[11] Patent Number: 4,946,309

[45] Date of Patent: Aug. 7, 1990

[54] SEALING PROFILE

[75] Inventor: Siegfried Glang, Hamburg, Fed. Rep. of Germany

[73] Assignee: Phoenix Aktiegesellschaft, Hamburg, Fed. Rep. of Germany

[21] Appl. No.: 353,212

[22] Filed: May 17, 1989

Related U.S. Application Data

[63] Continuation of Ser. No. 94,077, Sep. 4, 1987, abandoned, which is a continuation of Ser. No. 820,711, Jan. 17, 1986, abandoned.

[30] Foreign Application Priority Data

Jan. 26, 1985 [DE] Fed. Rep. of Germany ..... 3502620

[51] Int. Cl.[5] ..... E21D 11/38; E04B 1/68; E16J 15/02

[52] U.S. Cl. ..... 405/152; 285/352; 405/135; 277/201; 277/207 R; 277/215; 52/396

[58] Field of Search ..... 405/152, 135; 285/352, 285/910; 277/201, 202, 207 R, 208, 215; 52/396; 404/64, 65

[56] References Cited

U.S. PATENT DOCUMENTS

| | | | |
|---|---|---|---|
| 2,615,741 | 10/1952 | Nathan | 277/208 |
| 3,046,028 | 7/1962 | Nathan | 277/208 |
| 3,052,196 | 9/1962 | Gilmore | 277/208 |
| 3,347,769 | 10/1967 | Honsberg et al. | 277/208 |
| 3,695,044 | 10/1972 | Hoshino et al. | 405/152 |
| 3,829,107 | 8/1974 | Machado et al. | 277/207 |
| 4,195,850 | 4/1980 | Berger et al. | 405/135 |
| 4,199,158 | 4/1980 | de Munck | 405/135 |

FOREIGN PATENT DOCUMENTS

| | | | |
|---|---|---|---|
| 2553934 | 8/1976 | Fed. Rep. of Germany | 405/152 |
| 2519471 | 11/1976 | Fed. Rep. of Germany | 405/152 |
| 2833345 | 7/1978 | Fed. Rep. of Germany | 405/152 |
| 3008711 | 3/1980 | Fed. Rep. of Germany | 405/152 |
| 2415693 | 8/1979 | France | 405/152 |
| 2121457 | 5/1982 | United Kingdom | 405/152 |

OTHER PUBLICATIONS

*Primary Examiner*—Dennis L. Taylor
*Assistant Examiner*—John Ricci
*Attorney, Agent, or Firm*—Collard, Roe & Galgano

[57] ABSTRACT

A sealing profile made of rubber or rubber-like material for installation in a recess extending around concrete segments for a tunnel tube. The profile has on the base side a plurality of parallel grooves extending in the longitudinal direction, and parallel ducts extending in the longitudinal direction on the top side. The ducts are laterally displaced with respect to the grooves, and the back of the profile is substantially shaped with a plane surface. Of the three grooves provided on the base side, the center groove is from 10% to 20% deeper and wider than the adjacent grooves. In the center of the profile, the spacing between the ducts is larger than the spacing between the ducts disposed away from the center of the profile. The lateral sides of the profile are inclined at an angle of from 10 to 20 degrees.

4 Claims, 1 Drawing Sheet

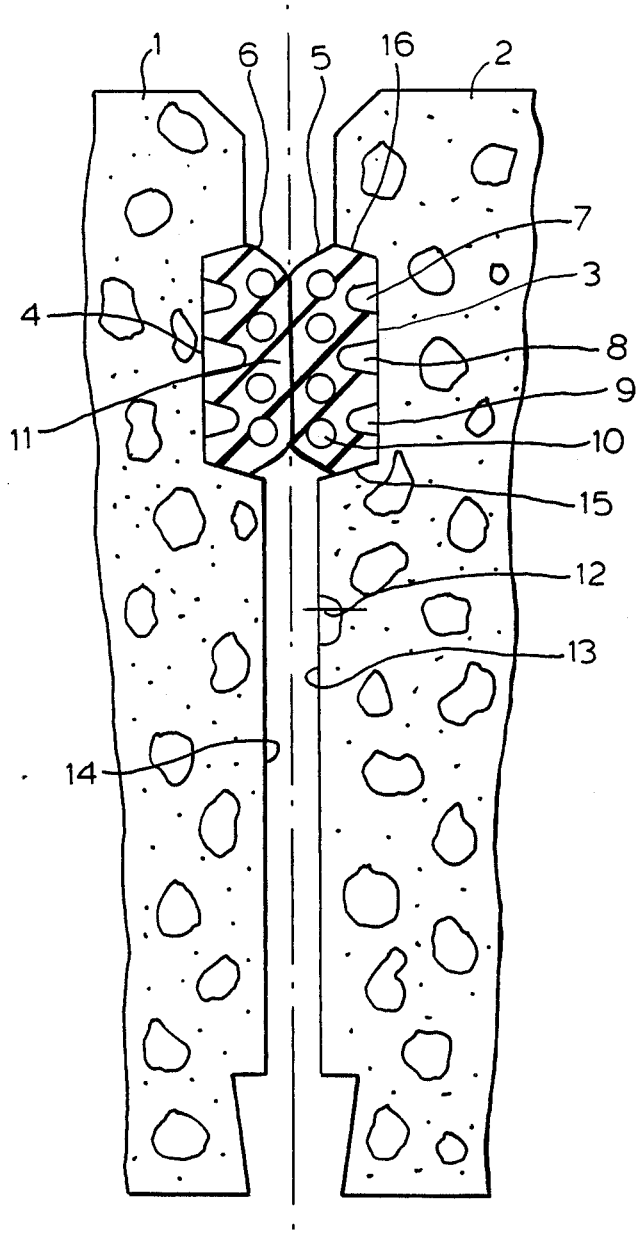
1
6
5
16
2
7
3
4
8
9
11
10
15
12
13
14

SEALING PROFILE

This is a continuation application of application Ser. No. 094,077, filed Sept. 4, 1987, now abandoned, which, in turn, is a continuation application of application Ser. No. 820,711, filed Jan. 17, 1986, for "SEALING PROFILE", abandoned.

BACKGROUND OF THE INVENTION

This invention relates to a sealing profile for use with concrete segments. More particularly, this invention relates to a sealing profile made of rubber or a rubber-like material such as for installation in a recess extending around concrete segment tubes for use in tunnels or for shaft installations.

Such a sealing or packing profile is known from German Patent No. DE PS 28 33 345. This profile has been successfully used in tunnel construction and in shaft installations using tubings. However, advanced developments in connection with the engineering of tubes for tunnels and the like, have led to additional requirements which sealing profiles made of rubber or a rubber-like material have to satisfy. It is desirable that the sealing profiles be narrow in relation to the wall thickness of the concrete segments without, however, reducing the areas of contact of the sealing profiles. A large seal supporting surface has to be maintained on the concrete segments so as to avoid as much as possible any increased stressing of these segments. Furthermore, these profiles are expected to be resistant to the effects of solvents, oils and greases, in order to assure that the intended gluing of the profile in the recess of the concrete segment is adequately secure. The volume of the profile material disposed in the recess of the concrete segment should be set so that the profile is fully accommodated in the recess when the concrete segments are brought together.

Accordingly, it is an object of the invention to provide a sealing profile of the type specified above, which permits a largely uniform deformation of all spatial elements of the profile in combination with secure adhesion of the profile, and a relatively narrow width.

SUMMARY OF THE INVENTION

Certain of the foregoing and related objects are readily attained in a resilient sealing profile for sealing concrete tube sections in tunnels and the like, having a base section defining a center groove and-two side grooves disposed on either side of the center groove. The center groove is from 10 to 20% deeper and wider than the side grooves. The base section has a substantially planar base surface and lateral sides inclined at an angle of from 10 to 20 degrees with respect to a plane perpendicular to the base surface. The center and side grooves extend in a direction parallel to the longitudinal axis of the profile A top section integral with the base section, defining a plurality of spaced apart parallel ducts extending in a direction parallel to the longitudinal axis of the profile is provided The ducts are laterally displaced with respect to the grooves, with the spacing between the ducts adjacent to the center of the profile being larger than the spacing between the ducts disposed away from the center of the profile.

Preferably, the sealing profile consists of rubber, a rubber-like material, or a rubber mixture based on polychloroprene, EPDM, or nitrile rubber. Most desirably, the plane of the maximum width of the profile also represents the plane of separation for the ducts and grooves, and the width of the base surface of the profile is from 70% to 80% of the maximum width of the profile. The sealing profile may be annular or ring shaped.

The technical features described above largely provide for the desired objective. If such profiles disposed back to back in recesses in the concrete sections are pressed together, the rubber mass is first displaced to a slight extent towards the center of the profile due to the angle of the sides of the profile. However, with such displacement, due to the force distribution, the profile is not lifted from the sides or edge area of the recess, so that secure adhesion between the profile and recess is maintained. The arrangement of the four ducts controls the directions of the compressive forces within the profile. Slight changes to the ducts may advantageously influence the tightness of the seal of the profiles.

Secure gluing or adhesion of the profiles on the bottom and sides of the recess is important because the rough surface of the concrete segments may lead to leaky spots in the recess.

When the rubber mass is displaced towards the center as a result of compression, stress equalization results from the fact that the center groove is slightly higher and wider than the side grooves. On the other hand, the greater amount of rubber mass disposed above the wider groove causes the back or base section of the profile to be stressed uniformly when loaded and deformed by pressure In this way, the specific surface pressure can be kept largely uniform across the total contact area between the profile and the recess in the segment. Also, any displacement of the concrete segments in the opposite direction with respect to their abutting surfaces cannot have any damaging effect on the sealing profile. Due to the fact that the profile is provided with angled sides, the profile cannot be squeezed off or crushed across the edge of the recess of the concrete segment.

Another important advantage is that owing to the way in which the profile is shaped and its edges are designed, all sections or areas within the profile are largely uniformly deformed when pressed together. Since such rubber profiles have to endure in such a deformed state for decades, it is important that such deformation will not cause damage to the profile. This largely even deformation of all sections or areas within the profile permits a greater range of variation in the preparation of the rubber mixture. Rubber mixtures which largely conform to other requirements, rather than stressability requirements, may be used.

By way of example, the use of a rubber mixture based on polychloroprene or nitrile rubber is preferred if reactive gases or liquids are to be expected. High resistance to aging is, in this connection, important even in the state of deformation of the profile. However, such high resistance to aging may be achieved also with the use of a mixture based on EPDM (ethylene propylene diene rubber).

Furthermore, it is useful that the plane of the maximum width of the profile represents also the plane of separation for the ducts and grooves, i.e. the profile's ducts and grooves are separated along an (imaginary) line across the profile at its maximum width. Moreover, the surface of the back of the profile should amount to about 70% to 80% of the maximum width of the profile. This leads to even compression of the profile without unnecessarily stressing the sides or edge zones to any high degree.

Other objects and features of the present invention will become apparent from the following detailed description considered in connection with the accompanying drawing, which discloses but a single embodiment of the invention. It is to be understood that the drawing is to be used for the purpose of illustration only, and not as a definition of the limits of the invention.

BRIEF DESCRIPTION OF THE DRAWING

The drawing is a sectional view of two concrete segments having ring-shaped sealing profiles, according to the invention arranged in recesses, with the profiles shown in the state prior to compression.

DESCRIPTION OF THE PREFERRED EMBODIMENT

Turning now in detail to the appended drawing, therein illustrated is a novel sealing profile embodying the present invention, wherein each of the two concrete segments 1 and 2 has a recess at 4 and 3, respectively, with the recesses opposing each other. On their base sections, each of sealing profiles 5 and 6 have curved grooves 7, 8 and 9. Center groove 8 is slightly larger and wider than side grooves 7 and 9. Four ducts 10 are also provided within the sealing profile.

In the center zone 11, the ducts have a slightly larger spacing between each other. When profiles 5 and 6 are pressed together at the time concrete segments 1 and 2 are fitted together (by screwing within zone 12), the rubber mass of sealing profiles 5 and 6 is displaced into the recesses 3 and 4 respectively. In the final state, the edges 13 and 14 of concrete segments 1 and 2 are solidly abutting each other. The rubber mass of sealing profiles 5 and 6 disposed above recesses 3 and 4 is now largely evenly deformed in a way such that no peak stresses are created in the rubber compound of the profiles. The contact pressure between the base sections of profiles 5 and 6 and recesses 3 and 4, respectively, is largely uniform as well. The lateral sides 15 and 16 have an angle of 16 degrees with respect to the horizontal axis.

Thus, while only a single embodiment of the present invention has been shown and described, it is obvious that many changes and modifications may be made thereunto, without departing from the spirit and scope of the invention.

What is claimed is:

1. A sealing profile formed of rubber or rubber-like material adapted to be inserted in a groove extending annularly in segments of a tunnel tube for sealing adjacent segments of the tunnel tube, said sealing profile comprising:

(a) a planar base surface having three longitudinally extending, parallel, curved grooves therein, the middle one of said grooves being 10 to 20 percent deeper and wider than the adjacent grooves;

(b) four parallel spaced apart ducts lying in a plane parallel to the base surface of said profile and laterally staggered with respect to said curved grooves, the middle two ducts disposed centrally in the profile having a greater spacing therebetween than the spacing between each one of said centrally disposed ducts and the outer duct adjacent thereto;

(c) a maximum lateral width defined by a plane parallel to the planar base surface and disposed between the plane of the four ducts and the base surface; and, (d) lateral flanks extending from said base surface inclined at an angle from 10 to 20 degrees with respect to a plane perpendicular to said base surface;

so that when respective sealing profiles in adjacent tunnel tube segments are pressed together, all sections of the profiles are evenly deformed and subjected to uniform stress throughout.

2. The sealing profile as defined in claim 1, wherein said sealing profile consists of a rubber mixture based on a member selected from the group consisting of polychloroprene, EPDM, and nitrile rubber.

3. The sealing profile as defined in claim 1, wherein the plane of the maximum width of the profile represents also the plane of separation for said ducts and grooves.

4. The sealing profile as defined in claim 1, wherein the width of said base surface of the profile is from 70% to 80% of the maximum width of the profile.

* * * * *